US008771002B2

(12) United States Patent
Chiu et al.

(10) Patent No.: US 8,771,002 B2
(45) Date of Patent: Jul. 8, 2014

(54) PLUG CONNECTOR AND CONNECTOR ASSEMBLY

(71) Applicant: GT Contact Co., Ltd., New Taipei (TW)

(72) Inventors: Jui-Jung Chiu, Taoyuan County (TW); Chih-Cheng Tsai, New Taipei (TW)

(73) Assignee: GT Contact Co., Ltd., New Taipei (TW)

( * ) Notice: Subject to any disclaimer, the term of this patent is extended or adjusted under 35 U.S.C. 154(b) by 69 days.

(21) Appl. No.: 13/662,461

(22) Filed: Oct. 27, 2012

(65) Prior Publication Data

US 2014/0120761 A1 May 1, 2014

(51) Int. Cl.
*H01R 13/62* (2006.01)

(52) U.S. Cl.
USPC ..... 439/348

(58) Field of Classification Search
USPC ..... 439/348, 319, 321
See application file for complete search history.

(56) References Cited

U.S. PATENT DOCUMENTS

| | | | | |
|---|---|---|---|---|
| 2,735,993 | A * | 2/1956 | Humphrey | 439/348 |
| 3,509,515 | A * | 4/1970 | Acord | 439/258 |
| 3,552,777 | A * | 1/1971 | Heinrich | 285/81 |
| 3,678,439 | A * | 7/1972 | Vetter | 439/253 |
| 3,808,579 | A * | 4/1974 | Mina et al. | 439/180 |
| 4,846,714 | A * | 7/1989 | Welsby et al. | 439/348 |
| 6,773,292 | B2 * | 8/2004 | Fawcett | 439/348 |
| 6,824,415 | B2 * | 11/2004 | Wlos | 439/348 |
| 7,357,659 | B2 * | 4/2008 | Yoshimori et al. | 439/348 |

* cited by examiner

*Primary Examiner* — Gary Paumen

(57) ABSTRACT

A plug connector comprises a terminal module and a connecting module. The connecting module comprises a shelter having a bump arranged on an outer wall thereof, a fixing nut screwing on one end of the shelter, a socket holder having a ridge arranged on an inner wall thereof, and a spring. The terminal module is inserted into the shelter. The shelter is inserted into the socket holder, and the ridge is disposed between the bump and the fixing nut for enabling the socket holder to move relative to the shelter. The shelter, the fixing nut, and the socket holder define an accommodating space. The spring is arranged in the accommodating space, wherein two opposite ends of the spring are respectively abutted on the ridge and the fixing nut for providing an elastic force.

10 Claims, 8 Drawing Sheets

PLUG CONNECTOR AND CONNECTOR ASSEMBLY

BACKGROUND OF THE INVENTION

1. Field of the Invention

The instant disclosure relates to a connector; more particularly, to a plug connector and a connector assembly.

2. Description of Related Art

In order to achieve the purpose of automatic control or transfer interaction between various types of the electronic equipment, that are relied corresponding connector to be a signal transduction media for achieving efficiency and stability connection between the electronic equipment.

The general connector assembly has a plug connector and a socket connector. The plug connector has a main body, a socket holder, and a fixing component. The socket holder is slidably installed on the main body for maintaining the connection between the plug connector and the socket connector. The fixing component is riveted on one end of the main body to stop the socket holder for preventing the socket holder from slipping out.

However, using rivet for fixing the fixing component on the main body will generate a gap between the fixing component and the main body after repeatedly using the socket holder or thermal expansion/contraction.

To achieve the abovementioned improvement, the inventors strive via industrial experience and academic research to present the instant disclosure, which can provide additional improvement as mentioned above.

SUMMARY OF THE INVENTION

The object of the instant disclosure is to provide a plug connector and a connector assembly having an improved structure.

The plug connector comprises a terminal module and a connecting module. The connecting module comprises a cannular shelter, a fixing nut, a socket holder, and a spring. The shelter defines a center line and has a bump arranged on an outer wall thereof, wherein the terminal module is inserted into the shelter. The fixing nut is screwing on one end of the shelter. The socket holder has a ridge arranged on an inner wall thereof, wherein the shelter is inserted into the socket holder, and the ridge is disposed between the bump and the fixing nut for enabling the socket holder to move relative to the shelter between a first position and a second position along the center line, and wherein the shelter, the fixing nut, and the socket holder define an accommodating space. The spring is arranged in the accommodating space, wherein two opposite ends of the spring are respectively abutted on the ridge and the fixing nut for providing an elastic force, and wherein the elastic force enables the socket holder to move from the second position toward the first position.

The connector assembly comprises a plug connector and a socket connector. The plug connector comprises a terminal module and a connecting module. The connecting module comprises a cannular shelter, a fixing nut, a socket holder, and a spring. The shelter defines a center line and has a bump arranged on an outer wall thereof, wherein the terminal module is inserted into the shelter. The fixing nut is screwing on one end of the shelter. The socket holder has a ridge arranged on an inner wall thereof, wherein the shelter is inserted into the socket holder, and the ridge is disposed between the bump and the fixing nut for enabling the socket holder to move relative to the shelter between a first position and a second position along the center line, and wherein the shelter, the fixing nut, and the socket holder define an accommodating space. The spring is arranged in the accommodating space, wherein two opposite ends of the spring are respectively abutted on the ridge and the fixing nut for providing an elastic force, and wherein the elastic force enables the socket holder to move from the second position toward the first position. The socket connector is detachably combined with the plug connector, wherein the socket connector comprises a mating terminal module and a coupling module. The coupling module comprises a cannular mating shelter and an O-ring. The mating shelter has an inner flange and a receiving trough spaced arranged on an inner wall thereof, wherein the mating terminal module is inserted into the mating shelter. The O-ring is disposed in the receiving trough and arranged on between the inner wall of the mating shelter and the outer wall of the shelter, wherein the internal diameter of the O-ring is smaller than the external diameter of the shelter for establishing a seamless connection between the O-ring and the shelter.

Based on the foregoing, the fixing nut is screwing on the shelter for preventing to separate from the shelter after repeatedly using the socket holder or thermal expansion/contraction.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
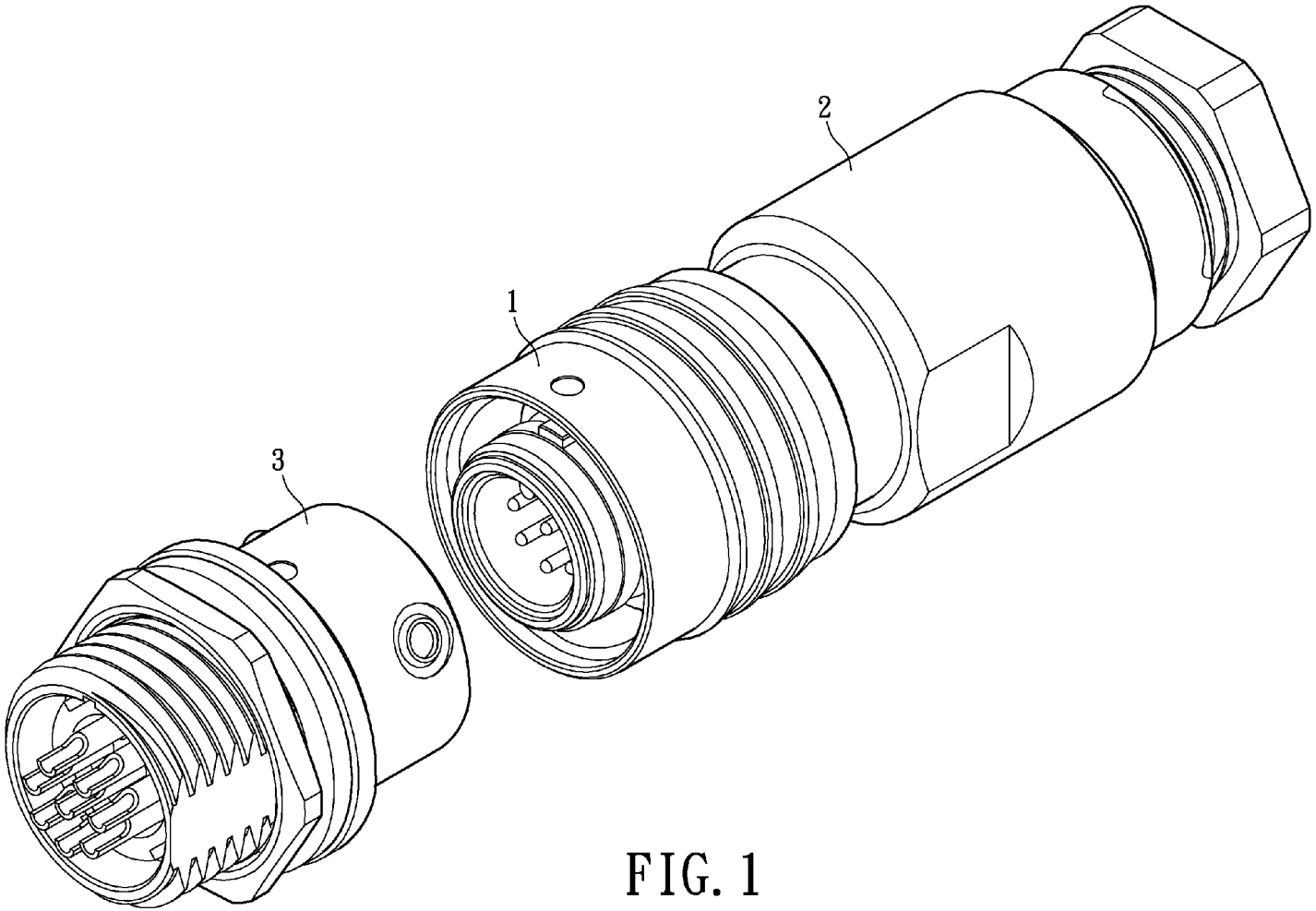
FIG. 1 an exploded view showing a connector assembly of the instant disclosure.
Figure 2:
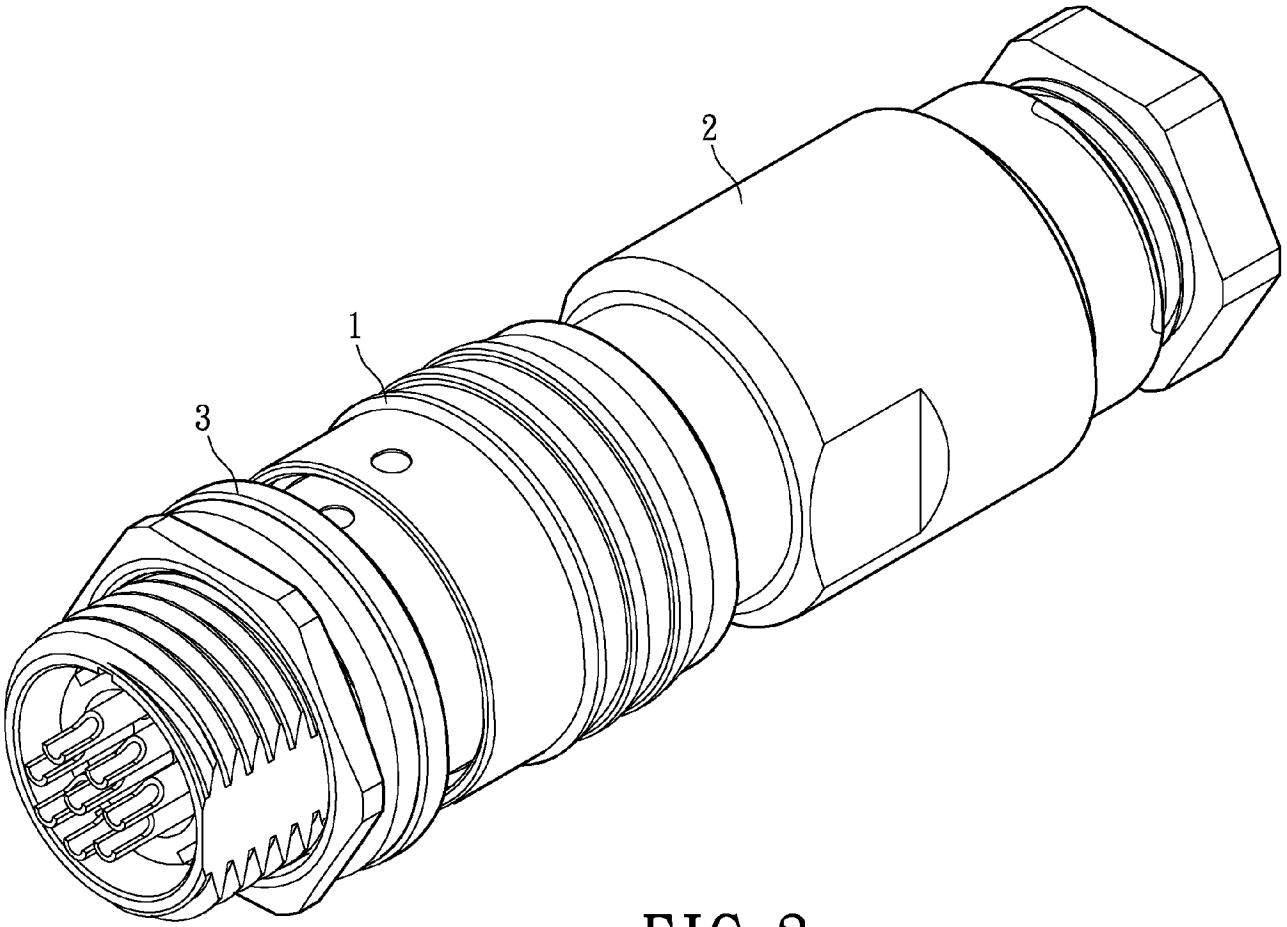
FIG. 2 is a perspective view showing the connector assembly of the instant disclosure.

Please refer to FIGS. 1 and 2, which show a connector assembly of the instant disclosure. The connector assembly includes a plug connector 1, a wire bundler 2, and a socket connector 3. Two opposite end portions of the plug connector 1 are respectively connected to the wire bundler 2 and the socket connector 3. The socket connector 3 is detachably combined with the plug connector 1.

Figure 3:
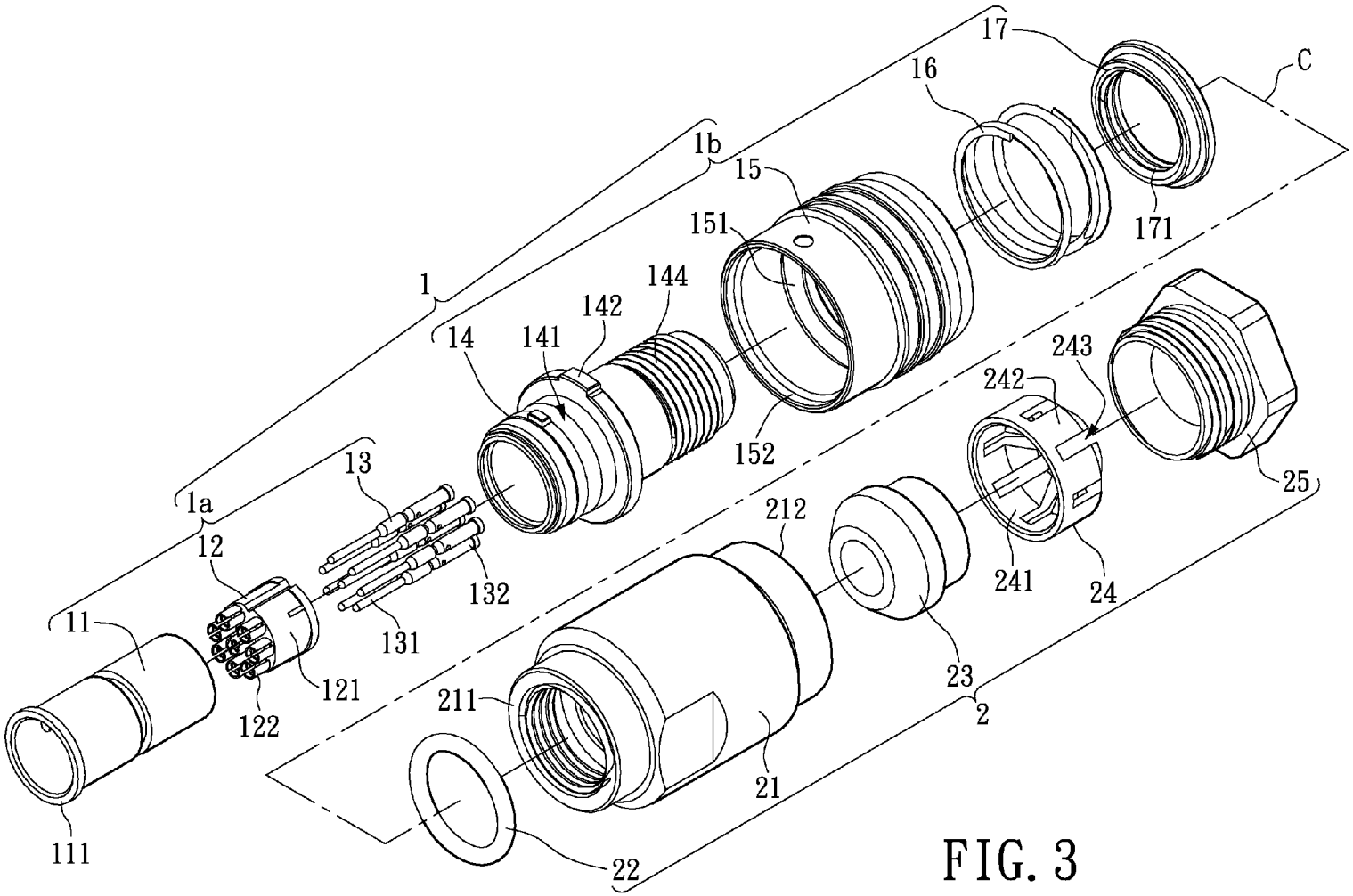
FIG. 3 an exploded view showing a plug connector and a wire bundler of the instant disclosure.
Figure 5:
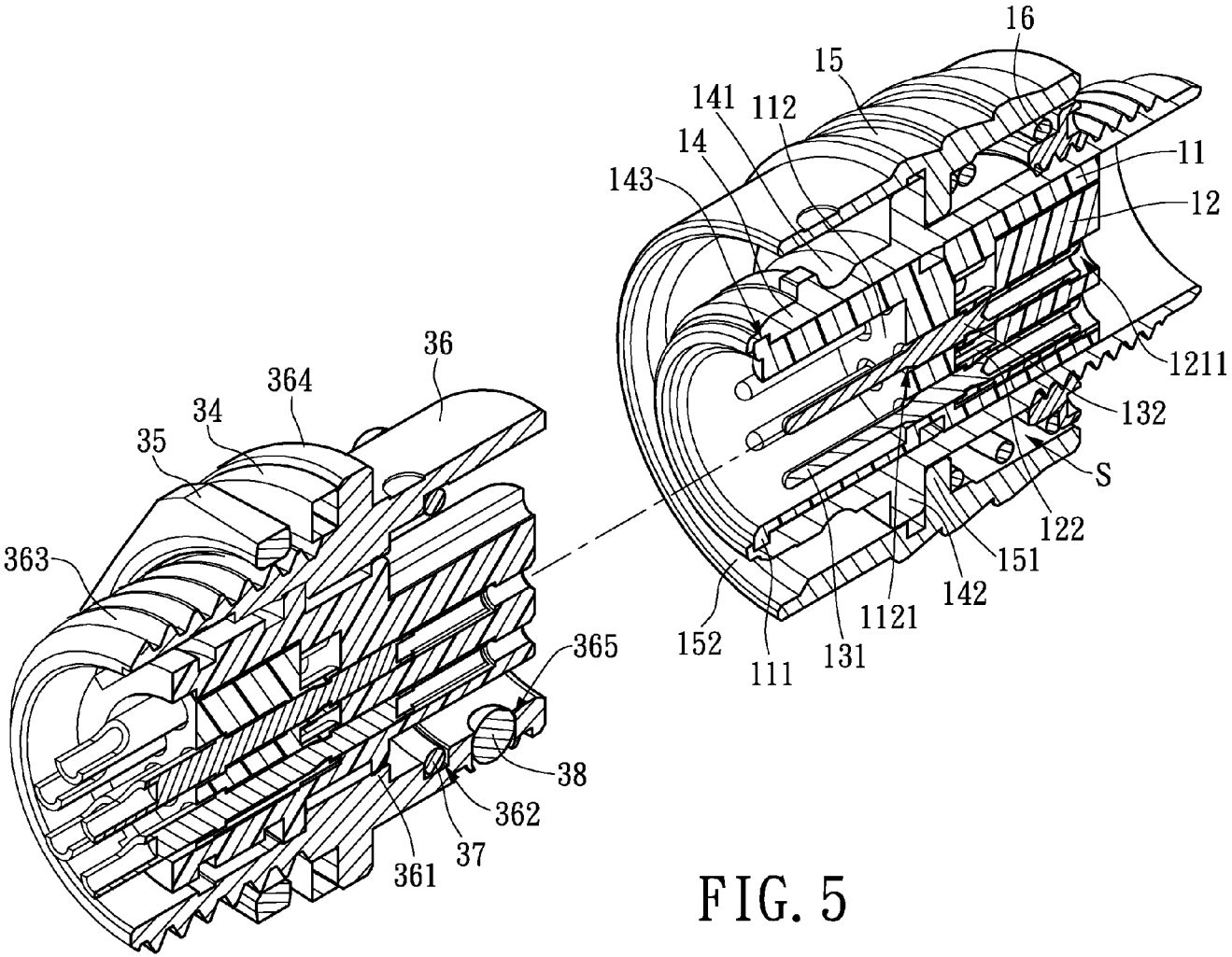
FIG. 5 is a cross-sectional view showing the plug connector and the socket connector.

Please refer to FIGS. 3 and 5. The plug connector 1 has a terminal module 1*a* and a connecting module 1*b*. The terminal module 1*a* has a cannular terminal sheath 11, a positioning block 12, and a plurality of terminals 13.

The terminal sheath 11 is preferably made of insulating material. The terminal sheath 11 has an end protrusion 111 arranged on an end portion thereof and a stop plate 112 arranged inside thereof. The stop plate 112 has a plurality of identical thru holes 1121 spaced arranged thereof. The distance between the stop plate 112 and an end of the terminal sheath 11 is equal to the distance between the stop plate 112 and an opposite end of the terminal sheath 11.

The positioning block 12 has a base portion 121 having an approximate cylindrical shape and a plurality of extension tubes 122. The base portion 121 has a plurality of thru holes 1211. The extension tubes 122 are respectively extended from the base portion 121 and communicated to the thru holes 1211.

The positioning block 12 is inserted into the terminal sheath 11, and the end edge of each extension tube 122 contacts the stop plate 112 of the terminal sheath 11.

Each terminal 13 has a contact portion 131 and a fixing portion 132 connected to the contact portion 131 and inserted into the positioning block 12. Specifically, the fixing portions 132 contact the inner surface of the positioning block 12, which defines the thru holes 1211, and the inner surface of the terminal sheath 11, which defines the thru holes 1121. Each contact portion 131 is closer the end protrusion 111 than each fixing portion 132.

The connecting module 1*b* includes a cannular shelter 14, a cannular socket holder 15, a spring 16, and a fixing nut 17. The shelter 14 defines a center line C and the shelter 14 is approximately symmetry relative to the center line C. The shelter 14 has an annular limited trough 141, an annular bump 142, and a thread portion 144. The limited trough 141, the bump 142, and the thread portion 144 are arranged on an outer wall of the shelter 14, and the bump 142 is arranged between the limited trough 141 and the thread portion 144.

The socket holder 15 has an annular ridge 151 arranged on an inner wall thereof and an annular stair portion 152 arranged on the inner wall adjacent to edge thereof. The distance between the ridge 151 and an end of the socket holder 15 is equal to the distance between the ridge 151 and an opposite end of the socket holder 15.

Specifically, the internal diameter of the stair portion 152 is gradually increased from the edge of the socket holder 15 to away from the edge of the socket holder 15. The internal diameter of the socket holder 15 excluding the ridge 151 is slightly larger than the external diameter of the bump 142.

The fixing nut 17 has a ring shape and a mating thread portion 171 formed on an inner wall thereof. The mating thread portion 171 conforms in shape to the thread portion 144, and the mating thread portion 171 of the fixing nut 17 is screwed on the thread portion 144 of the shelter 14.

The shelter 14 is inserted into the socket holder 15. The shelter 14, the fixing nut 17, and the socket holder 15 define an accommodating space S.

Figure 6:
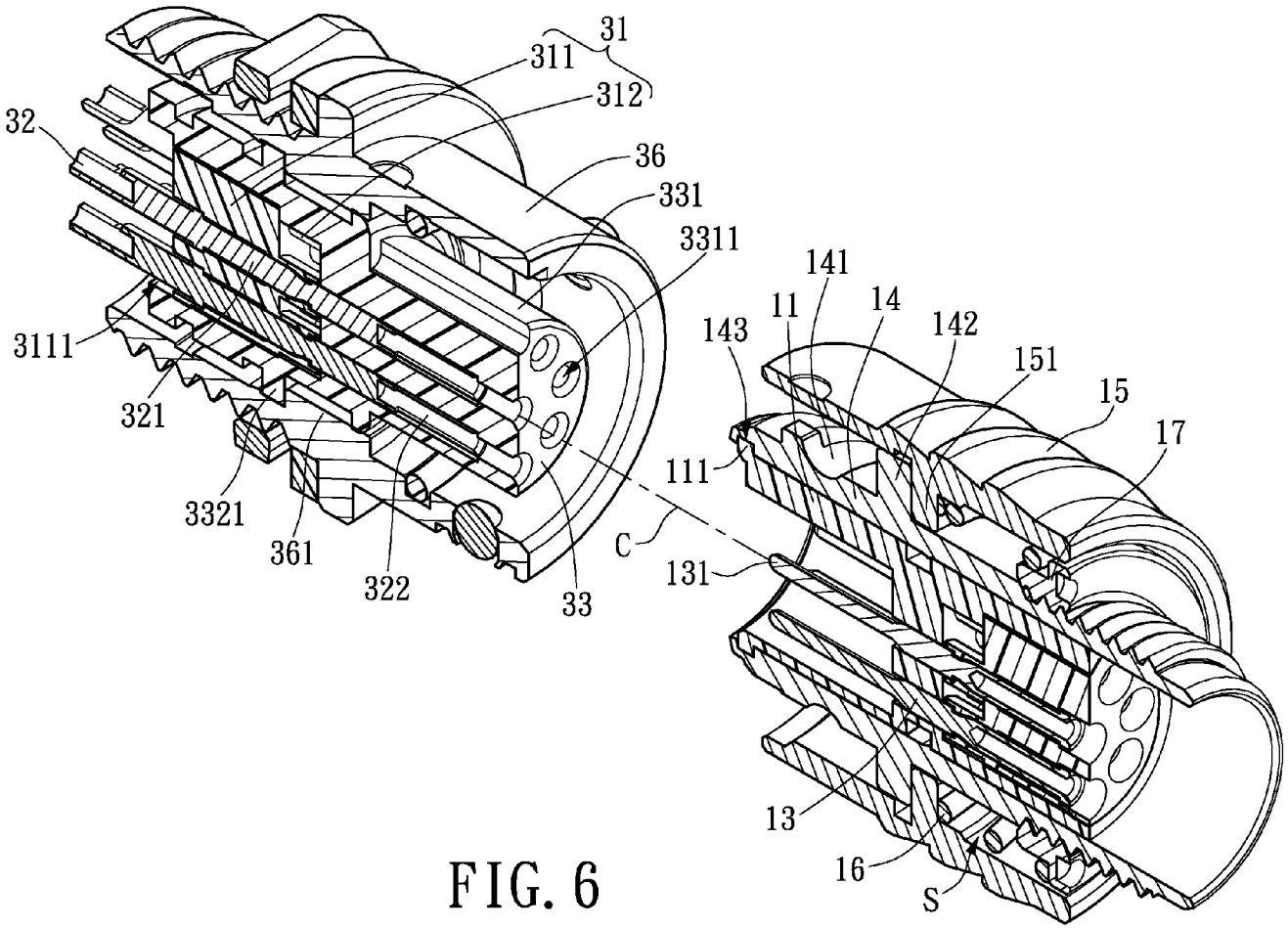
FIG. 6 is another cross-sectional view showing the plug connector and the socket connector.

Please refer to FIG. 6. The terminal sheath 11 is inserted into the shelter 14, and the end portion of the terminal sheath 11 is riveted to an end portion of the shelter 14. Specifically, the end portion of the shelter 14 is bent to define a positioning trough 143, and the end protrusion 111 of the terminal sheath 11 is riveted to the positioning trough 143 of the shelter 14.

Figure 7:
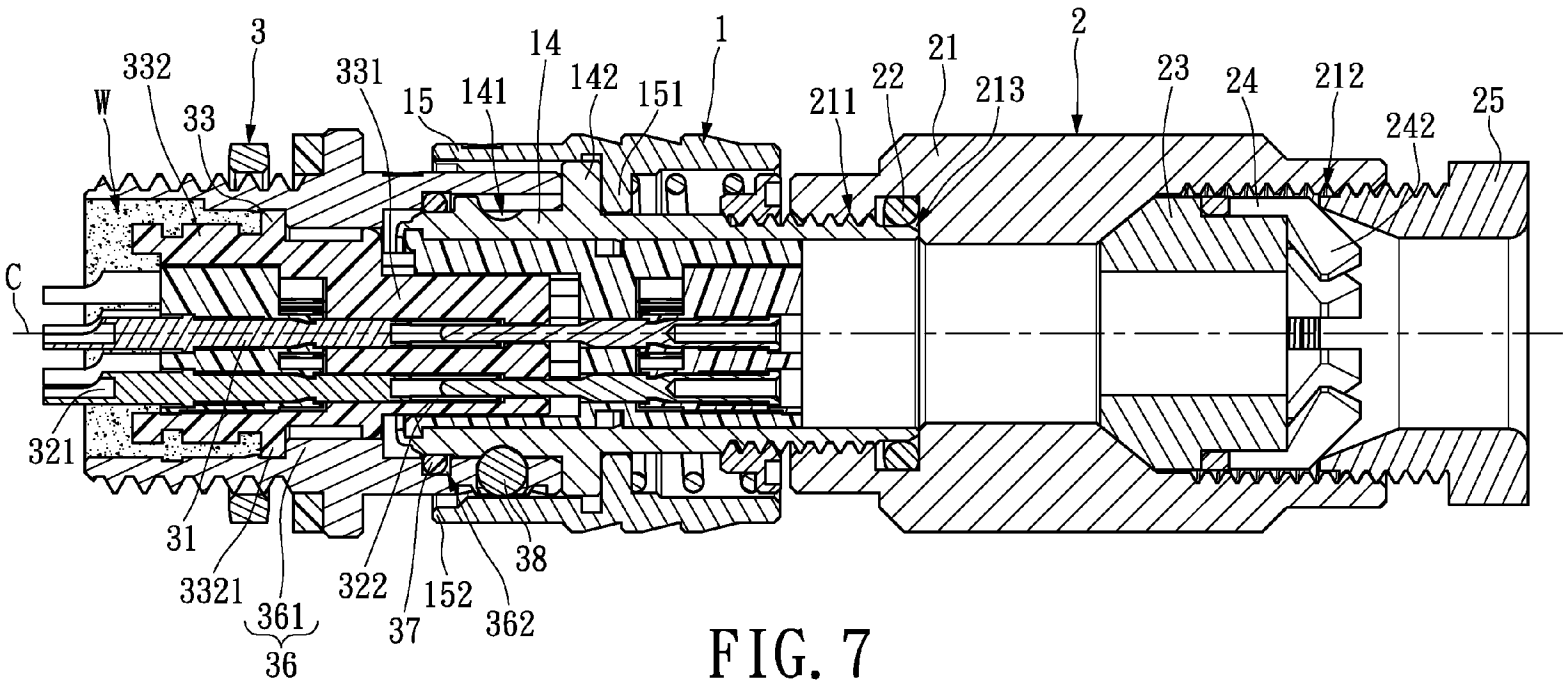
FIG. 7 is a cross-sectional view showing the connector assembly when the socket holder at a first position.
Figure 8:
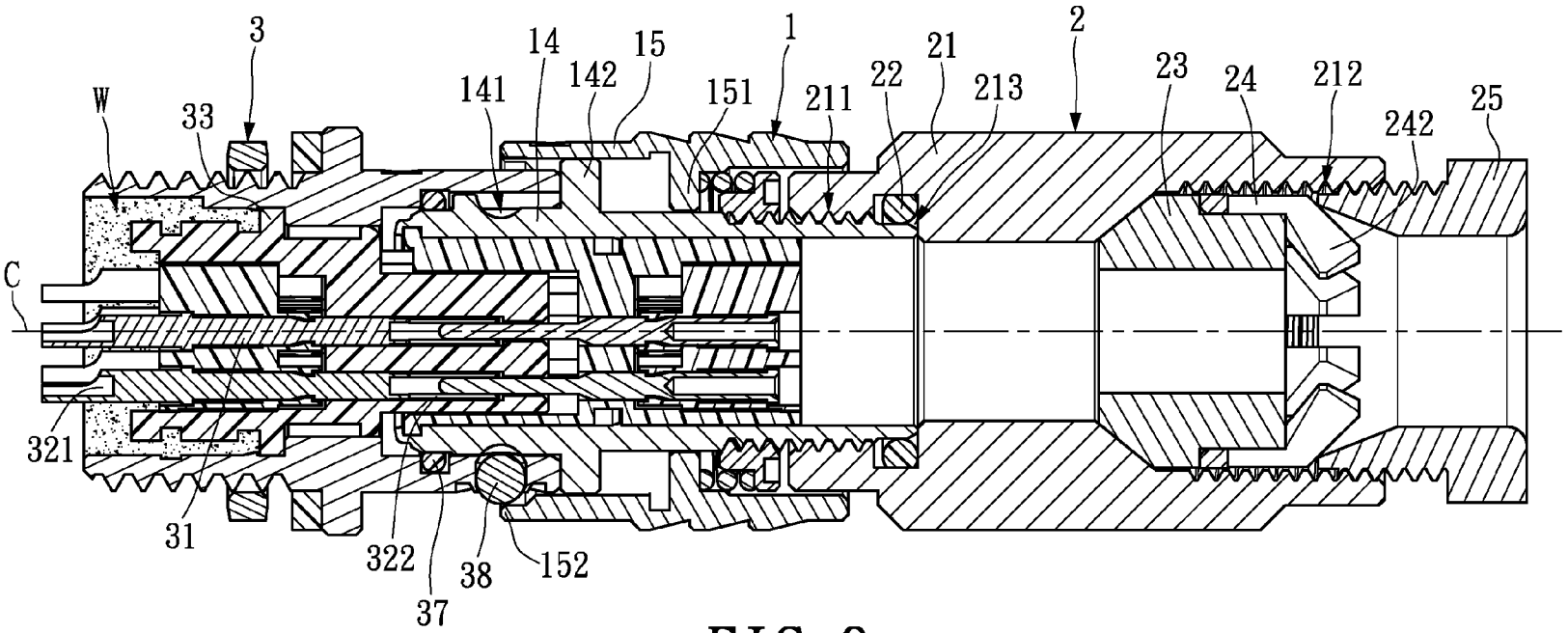
FIG. 8 is a cross-sectional view showing the connector assembly when the socket holder at a second position.

The ridge 151 is arranged between the bump 142 and the fixing nut 17 for enabling the socket holder 15 to move relative to the shelter 14 between a first position (as FIG. 7 shown) and a second position (as FIG. 8 shown) along the center line C.

The spring 16 is arranged in the accommodating space S. Two opposite ends of the spring 16 are respectively abutted on the ridge 151 and the fixing nut 17 for providing an elastic force. The elastic force enables the socket holder 15 to move from the second position toward the first position.

Please refer to FIGS. 3 and 7. The wire bundler 2 includes an interconnecting tube 21, an O-ring 22, a medium component 23, a bundler 24, and a compressing nut 25.

The interconnecting tube 21 has a first opening portion 211 and a second opening portion 212. The internal diameter of the first opening portion 211 is smaller than the internal diameter of the second opening portion 212. The interconnecting tube 21 has a concave trough 213 formed on the inner wall thereof and adjacent to the first opening portion 211. The O-ring 22 is disposed in the concave trough 213 of the interconnecting tube 21.

The bundler 24 has a ring portion 241, a plurality of paws 242 connected to the ring portion 241. The paws 242 are spaced arranged in circle, that is to say, each two adjacent paws 242 has a gap 243 therebetween.

The medium component 23 and the bundler 24 are disposed in the interconnecting tube 21 adjacent to the second opening portion 212, and the bundler 24 contacts the medium component 23 and the interconnecting component 21.

The compressing nut 25 has a cannular shape and screwed on the second opening portion 212 of the interconnecting tube 21. The edge of the compressing nut 25 abuts on the outer surface of the paws 242.

Specifically, when screwing the compressing nut 25 into the interconnecting tube 21, the compressing nut 25 abuts on the paws 242 for closing the end of each paw 242. Thus, when a plurality of wires are installed in the wire bundler 2 and electrically connected to the plug connector 1, the wires can be bundled by the wire bundler 2.

Figure 4:
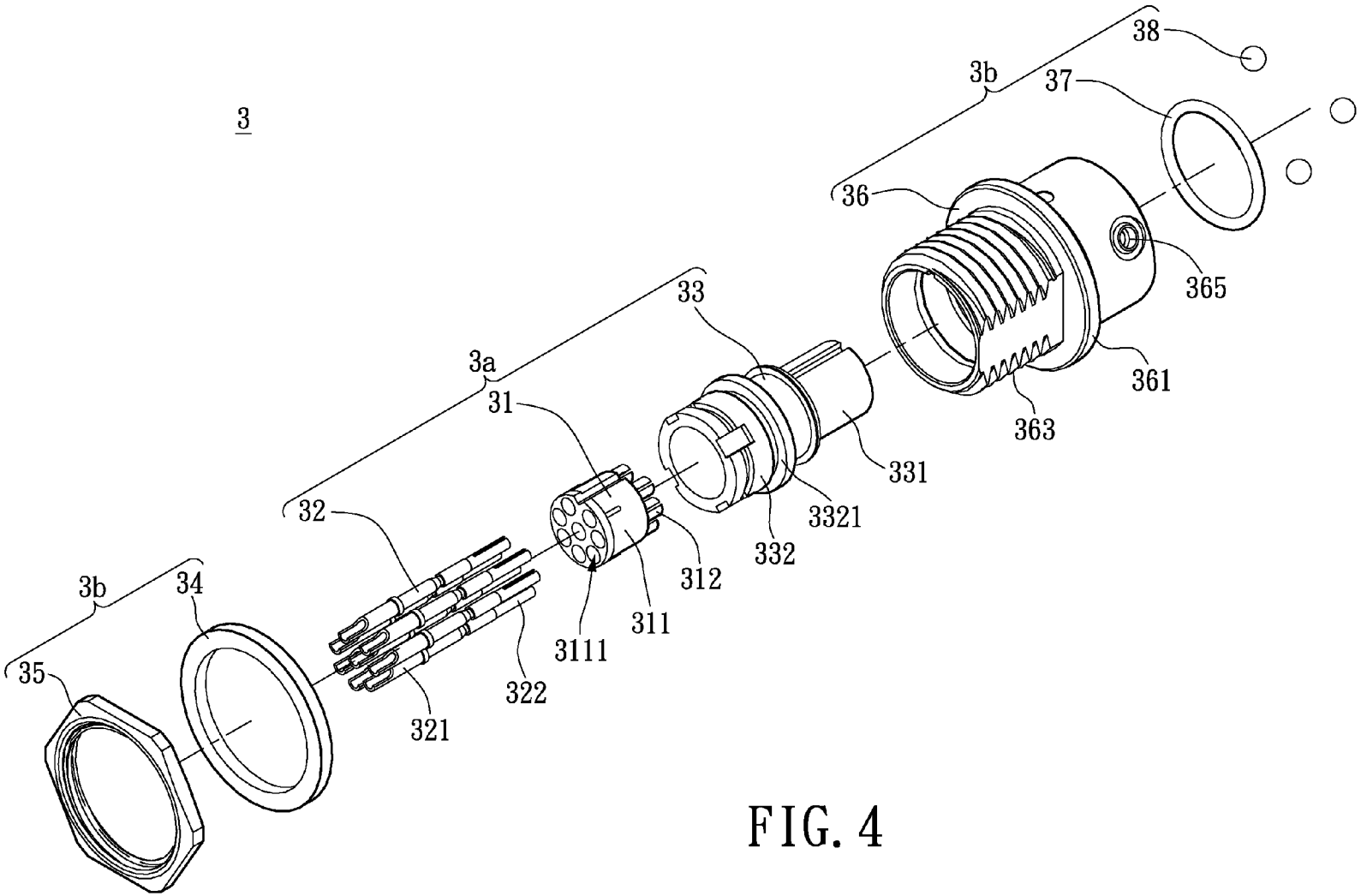
FIG. 4 an exploded view showing a socket connector of the instant disclosure.

Please refer to FIGS. 4, and 5. The socket connector 3 has a mating terminal module 3*a* and a coupling module 3*b*. The coupling module 3*b* has a washer 34, a nut 35, a cannular mating shelter 36, an O-ring 37, and three balls 38.

The mating shelter 36 has an annular inner flange 361 and a receiving trough 362, which are spaced arranged on an inner wall thereof. The mating shelter 36 has a thread portion 364 and an annular outer flange 365, which are spaced arranged on an outer wall thereof. The mating shelter 36 has three receiving compartments 365 spaced arranged in circle and penetrating the inner wall and the outer wall thereof. The outer flange 364 is arranged between the thread portion 363 and the receiving compartments 365. The receiving trough 362 is arranged between the inner flange 361 and the receiving compartments 365. The O-ring 37 is disposed in the receiving trough 362.

The material of the washer 34 is not limited. The nut 35 has a thread formed on the inner wall thereof. The washer 34 and the nut 35 are fixed around one side portion of the mating shelter 36. In other words, the washer 34 is clipped between the nut 35 and the inner flange 361, and the nut 35 abuts on the washer 34 and screws on the thread portion 363 of the mating shelter 36.

The shape of each ball 38 is corresponding to the shape of each receiving compartment 365. The balls 38 are respectively rollably engaged in the receiving compartment 365 of the mating shelter 36. Two opposite portions of each ball 38 are respectively exposed out of an inner surface and an outer surface of the mating shelter 36.

Specifically, as shown in FIG. 7, when the plug connector 1 is inserted into the socket connector 3, the balls 38 are forced to restrict in the limited trough 141 by moving the socket holder 15 to the first position. Moreover, the O-ring 37 is disposed in the receiving trough 362 and arranged on between the inner wall of the mating shelter 36 and the outer wall of the shelter 14. The internal diameter of the O-ring 37 is smaller than the external diameter of the shelter 14 for establishing a seamless connection between the O-ring 37 and the shelter 14.

Please refer to FIGS. 4 and 6. The mating terminal module 3*a* has a positioning block 31 having a cylindrical shape, a plurality of mating terminals 32, and a mating terminal sheath 33 having an approximately cylindrical shape.

The positioning block 31 has a base portion 311 and a plurality of extension tubes 312. The base portion 311 has a plurality of thru holes 3111. The extension tubes 312 are respectively extended from the base portion 311 and communicated to the thru holes 3111.

The mating terminal sheath 33 is preferably made of insulating material. The mating terminal sheath 33 has a guiding portion 331 and a receiving portion 332 extended from the guiding portion 331. The guiding portion 331 has a cylindrical shape having a plurality of thru holes 3311. The receiving portion 332 has an annular rib 3321 arranged on an outer wall thereof.

Each mating terminal 32 has a contact portion 322 and a fixing portion 321 connected to the contact portion 322 and inserted into the positioning block 31. The mating terminals 32 are respectively inserted into the thru holes 3111, 3311.

Please refer to FIGS. 7 and 8. The positioning block 31 is inserted into the receiving portion 332 of the mating terminal sheath 33. The mating terminal sheath 33 is inserted into the mating shelter 36, and the rib 3321 abuts on the inner flange 361. The space surrounded by the receiving portion 332 and the mating shelter 36 is filled with glue, which is defined as a glue portion W, for achieving the water-proof effect.

When the socket holder 15 is at the first position, the bump 142 of the shelter 14 abuts the ridge 152 of the socket holder 15, the balls 38 are received in the limited troughs 141, and the balls 38 abut on the shelter 14 and the socket holder 15. Thus, the plug connector 1 and the socket connector 3 do not be separated by restricting the balls 38 in the limited troughs 141.

When the socket holder 15 is forced to move along the center line C from the first position to the second position, the stair portion 152 provides enough space for the balls 38 to detach from the limited troughs 141. Thus, the bump 142 of the shelter 14 is located away from the ridge 151 of the socket holder 15, so that the plug connector 1 and the socket connector 3 can be separated along the center line C.

Based on the foregoing, the instant disclosure has the following effects. The fixing nut is screwed on the shelter for prevent separating from the shelter after repeatedly using the socket holder, thermal expansion/contraction, or forced by the elastic force. The fixing nut is replaced with another one easily by screwing out from the shelter. The manufacturing cost of the connector is reduced by screwing the fixing nut instead of riveting.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A plug connector, comprising:
a terminal module; and
a connecting module comprising:
a cannular shelter defining a center line and having a bump arranged on an outer wall thereof, wherein the terminal module is inserted into the shelter;
a fixing nut screwed onto one end of the shelter;
a socket holder having a ridge arranged on an inner wall thereof, wherein the shelter is inserted into the socket holder, and the ridge is disposed between the bump and the fixing nut for enabling the socket holder to move relative to the shelter between a first position and a second position along the center line, and wherein the shelter, the fixing nut, and the socket holder define an accommodating space; and
a spring arranged in the accommodating space, wherein two opposite ends of the spring are respectively abutted on the ridge and the fixing nut for providing an elastic force, and wherein the elastic force enables the socket holder to move from the second position toward the first position.

2. The plug connector as claimed in claim 1, wherein the shelter has a thread portion formed on the outer wall thereof, the fixing nut has a ring shape and a mating thread portion formed on an inner wall thereof, and the mating thread portion of the fixing nut is screwed on the thread portion of the shelter.

3. The plug connector as claimed in claim 1, wherein the terminal module has a cannular terminal sheath inserted into the terminal shelter along the center line, and wherein an end portion of the terminal sheath is riveted to an end portion of the shelter.

4. The plug connector as claimed in claim 3, wherein the shelter has a positioning trough formed on the end portion thereof, the terminal sheath has an end protrusion arranged on the end portion thereof, and the end protrusion of the terminal sheath is riveted to the positioning trough of the shelter.

5. A connector assembly, comprising:
a plug connector comprising:
a terminal module; and
a connecting module comprising:
a cannular shelter defining a center line and having a bump arranged on an outer wall thereof, wherein the terminal module is inserted into the shelter;
a fixing nut screwed onto one end of the shelter;
a socket holder having a ridge arranged on an inner wall thereof, wherein the shelter is inserted into the socket holder, and the ridge is disposed between the bump and the fixing nut for enabling the socket holder to move relative to the shelter between a first position and a second position along the center line, and wherein the shelter, the fixing nut, and the socket holder define an accommodating space; and
a spring arranged in the accommodating space, wherein two opposite ends of the spring are respectively abutted on the ridge and the fixing nut for providing an elastic force, and wherein the elastic force enables the socket holder to move from the second position toward the first position; and
a socket connector detachably combined with the plug connector,
wherein the socket connector comprises:
a mating terminal module; and
a coupling module comprising:
a cannular mating shelter having an inner flange and a receiving trough spaced arranged on an inner wall thereof, wherein the mating terminal module is inserted into the mating shelter; and
an O-ring disposed in the receiving trough and arranged on between the inner wall of the mating shelter and the outer wall of the shelter, wherein the internal diameter of the O-ring is smaller than the external diameter of the shelter for establishing a seamless connection between the O-ring and the shelter.

6. The connector assembly as claimed in claim 5, wherein the sheath has a limited trough formed on the outer wall thereof and arranged on one side of the ridge away from the fixing nut, wherein the coupling module has a plurality of balls rollably engaged on the mating shelter, wherein two opposite portions of each ball are respectively exposed out of an inner surface and an outer surface of the mating shelter, and wherein when the plug connector is inserted into the socket connector, the balls are forced to restrict in the limited trough by moving the socket holder to the first position.

7. The connector assembly as claimed in claim 5, wherein the terminal module has a positioning block and a plurality of terminals, wherein each terminal has a contact portion and a fixing portion connected to the contact portion and inserted into the positioning block.

8. The connector assembly as claimed in claim 5, wherein the mating terminal module comprises:

a positioning block;

a plurality of mating terminals respectively inserted into the positioning block; and a mating terminal sheath having a cannular shape, wherein the positioning block is inserted into the mating terminal sheath along the center line, and wherein the mating terminal sheath is installed in the mating shelter.

9. The connector assembly as claimed in claim 8, wherein each mating terminal has a contact portion and a fixing portion connected to the contact portion and inserted into the positioning block.

10. The connector assembly as claimed in claim 5, wherein when the socket holder is at the first position, the bump of the shelter abuts the ridge of the socket holder, and wherein when the socket holder is at the second position, the bump of the shelter is located away from the ridge of the socket holder.

* * * * *